US005277653A

United States Patent [19]

Gadgil

[11] Patent Number: 5,277,653

[45] Date of Patent: Jan. 11, 1994

[54] GAS FLOW MEANS FOR IMPROVING EFFICIENCY OF EXHAUST HOODS

[75] Inventor: Ashok J. Gadgil, El Cerrito, Calif.

[73] Assignee: The Regents, University of California, Oakland, Calif.

[21] Appl. No.: 757,716

[22] Filed: Sep. 11, 1991

[51] Int. Cl.[5] ..... B08B 15/00

[52] U.S. Cl. ..... 454/63; 2/DIG. 1; 454/66; 454/370

[58] Field of Search ..... 2/2, 102, DIG. 1; 454/69, 454/56, 63, 66, 370

[56] References Cited

U.S. PATENT DOCUMENTS

| | | | |
|---|---|---|---|
| 1,324,834 | 12/1919 | Lumby | 454/66 X |
| 3,113,320 | 12/1963 | Cherowbrier et al. | 454/370 X |
| 4,195,363 | 4/1980 | Jenson | 2/DIG. 1 X |
| 4,558,466 | 12/1985 | Kristensson | 2/DIG. 1 X |
| 5,074,198 | 12/1991 | Aalto et al. | 454/63 X |

OTHER PUBLICATIONS

Flynn et al., "Aerodynamics and Exposure Variability", *Appl. Occup. Environ. Hyg.* 6(1), Jan., 1991, pp. 36-39.

George, Dennis K., et al., "The Impact of Boundary Layer Separation on Local Exhaust Design and Worker Exposure", *Appl. Occup. Environ. Hyg.* 5(8), Aug., 1990, pp. 501-509.

*Primary Examiner*—Harold Joyce

*Attorney, Agent, or Firm*—Paul Martin; Kathleen S. Moss; Pepi Ross

[57] ABSTRACT

Apparatus for inhibiting the flow of contaminants in an exhaust enclosure toward an individual located adjacent an opening into the exhaust enclosure by providing a gas flow toward a source of contaminants from a position in front of an individual to urge said contaminants away from the individual toward a gas exit port. The apparatus comprises a gas mani-fold which may be worn by a person as a vest. The manifold has a series of gas outlets on a front face thereof facing away from the individual and toward the contaminants to thereby provide a flow of gas from the front of the individual toward the contaminants.

2 Claims, 7 Drawing Sheets

GAS FLOW MEANS FOR IMPROVING EFFICIENCY OF EXHAUST HOODS

The invention described herein arose in the course of, or under, Contract No. DE-AC03-76SF00098 between the United States Department of Energy and the University of California.

BACKGROUND OF THE INVENTION

1. Field of the Invention

This invention relates to apparatus for improving the efficiency of fume hoods by inhibition or elimination of eddy currents from forming in front of an operator.

2. Description of the Related Art

Exhaust hoods are widely used in industry to protect workers from exposure to fumes, aerosols, or any other air borne contaminates to which the worker might otherwise be exposed. Such exhaust hoods may comprise small hoods such as found in chemical labs or may comprise large hoods placed over large pieces of equipment, e.g., a cleaning vat or a boat under construction. The protective structure may even comprise entire rooms or enclosures, such as a paint booth or the like with exhaust ports or vents located either at the rear or top of the enclosure. In each case, however, the exhaust port or vent is usually in a position where the source of contaminants is in between the worker and the exhaust port.

In each such case, the purpose or point of the exhaust means is to remove the airborne contaminates from the enclosure and thereby protect the worker, who is either within or adjacent to the enclosure containing such airborne contaminants. However, George et al. in "The Impact of Boundary Layer Separation on Local Exhaust Design and Worker Exposure", published in Appl. Occup. Hyg. 5(8) at pages 501–509 in August 1990, showed that eddy currents could form in front of a worker due to the positioning of the worker in the air stream flowing toward the exhaust port. In particular, the article showed, in FIG. 1, that air flowing around a circular cylinder formed eddy currents on the downstream side of the cylinder which tend to flow inwardly toward the front or dead space adjacent the downstream side of the cylinder. Thus, when the source of airborne contamination is conventionally positioned between the person and the exhaust port, some of the airborne contamination may be drawn back toward the person by such eddy currents, the exact opposite of the desired effect!

This effect is further illustrated in FIGS. 1 and 2 of the drawings. FIG. 1 shows a top view showing air, from an air source 2 located behind a person identified by numeral 4, flowing around person 4 and the horizontal eddy currents which are developed by this flow of the air around person 4 which tends to draw the pollutants emitted from the source of contamination 6 back toward the person instead of toward exhaust port 8. FIG. 2 is a side view of person 4 of FIG. 1 showing how the air flow from source 2 flowing around person 4 toward exhaust port 8 is further thought to generate vertical eddy currents in front of the person which swirl upwardly in front of the person toward the breathing zone.

Increasing the total air flow into the exhaust hood will not totally remedy this problem. While an increase in the total air flow from a hood face velocity of, for example, about 56 feet per minute (fpm) up to a higher hood face velocity of, for example, about 118 fpm will result in an extension of the eddy current region, resulting in a dilution of the amount of contaminants swept back toward the person by the eddy currents. This results in the need for larger exhaust fans consuming more electrical power, thus adding additional expense to the exhaust system. Furthermore, exhaust hoods with high air flow rates require substantial make-up air to be introduced into a building which must then must be conditioned (i.e., heated or cooled) which takes additional energy. If air pollution abatement regulations require the trapping of pollutants from the exhaust, by filtration of solids and/or condensation of volatiles, operation at high air flow rates will result in yet further added costs.

The aforementioned George et al. article reported that smoke tests conducted with a mannequin indicated that when the mannequin was placed sideways in the airstream, that is, with the air coming and leaving from opposite sides of the mannequin, none of the smoke in front of the mannequin was reported to be drawn toward the breathing zone of the mannequin.

This observation is further reported in another article entitled "Aerodynamics and Exposure Variability" by Flynn and George, two of the three authors of the first publication. In this article, the authors examine the differences in effect of air flow when the air is supplied from the back of the mannequin and the contaminant source is placed in the near wake in front of the mannequin created by the air flow around the mannequin rather than flowing the air toward the side of the mannequin while the contaminant source remains in front of the mannequin.

While these articles appear to conclude that the position of the worker, with respect to both the air source and the contaminant source, can be varied to vary the amount of exposure to contaminants which flow back to the breathing zone of the person due to eddy current generation, it is not always convenient for the worker to vary his/her working position with respect to either the air source and/or the source of the airborne contamination.

What would be desirable is a means for making a person transparent to the air flow, i.e., a means wherein the air flow from the air source would flow toward the contaminant source, and then flow toward the exhaust port (with the contaminant entrained therein), without any obstruction caused by the presence of the person, regardless of his/her location with respect to either the air source or the contaminant source.

SUMMARY OF THE INVENTION

It is, therefore, an object of the invention to provide apparatus which will inhibit the flow of contaminants in an exhaust enclosure toward an individual located adjacent an opening into the exhaust enclosure.

It is another object of the invention to provide apparatus which will provide a gas flow toward a source of contaminants from a position in front of an individual to urge said contaminants away from the individual toward a gas exit port.

These and other objects of the invention will be apparent from the following description and accompanying drawings.

DETAILED DESCRIPTION OF THE INVENTION

Figure 3:
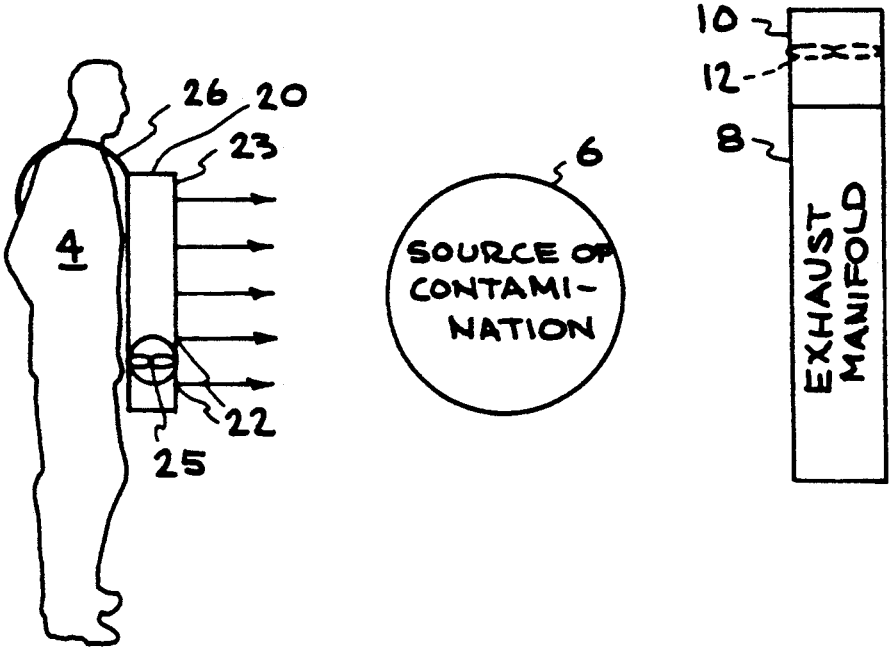
FIG. 3 is a vertical side view showing a person wearing the apparatus of the invention to provide a gas flow from the front of the person toward the source of contaminants.
Figure 4:
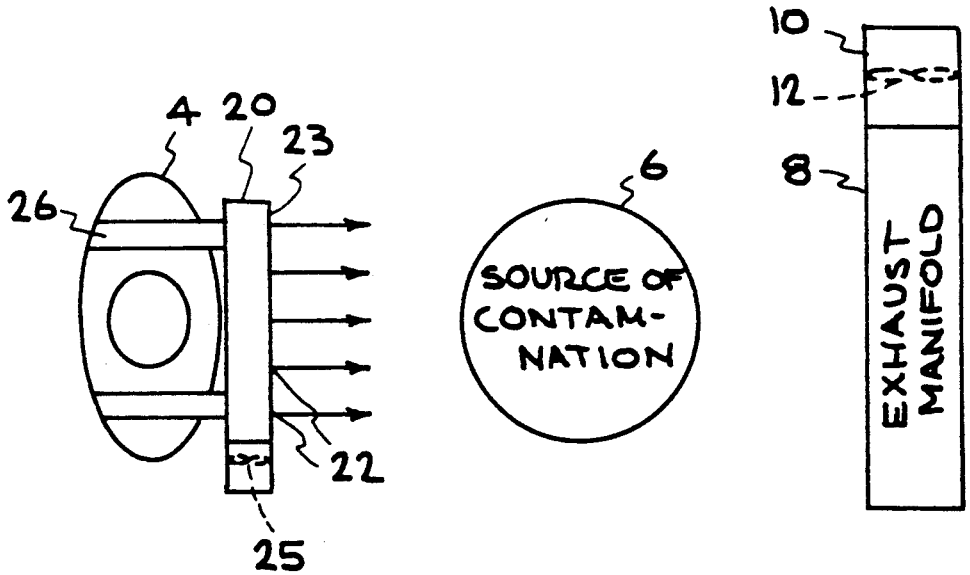
FIG. 4 is a top view of the person and apparatus illustrated in FIG. 3 showing the horizontal flow of gas from the apparatus toward the source of contaminants.
Figure 5:
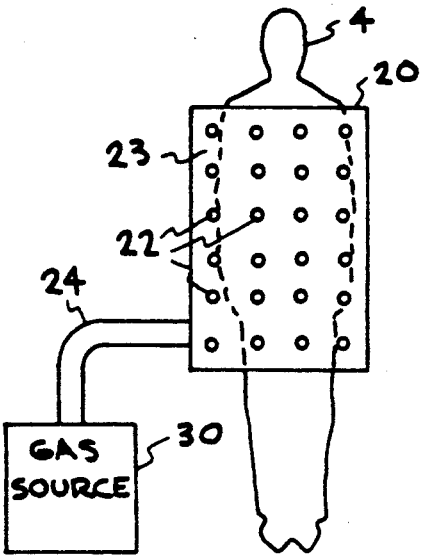
FIG. 5 is a vertical front view showing a person wearing apparatus of the invention similar to that shown in FIGS. 3 and 4, except that a gas supply is shown.

Referring now to FIGS. 3–5, the apparatus of the invention is shown comprising a gas manifold 20 which may be worn by a person as a vest, using support straps 26, and having a series of gas outlets 22 on front face 23 thereof facing away from the wearer to thereby provide a flow of gas from the front of person 4 wearing manifold 20 toward contaminants 6. This flow of gas from manifold 20 on the front of wearer 4 tends to entrain contaminants 6 in the gas flow which then passes into exhaust manifold 8, from which the entrained contaminants are removed through exhaust port 10 via exhaust fan 12.

While manifold 20 and front face 23 thereon appear to be constructed of solid material, i.e., metal, solid plastic, wood, or the like, at least front face 23 may be constructed of a porous material such as a porous plastic, or a more flexible material such as a porous cloth, either of which will permit the gas to flow therethrough, thereby making the provision of gas openings 22 therein unnecessary.

As shown in the drawings, the gas in manifold 20 which passes out of manifold 20 via openings 22 may, in the embodiment shown in FIG. 3, be provided from one or more fans 25 positioned in a sidewall of manifold 20, or, as shown in FIG. 5, be provided from a gas source 30 connected to manifold 20 via a flexible tube 24. Gas source 30 may comprise a fan with an opening to collect gas, e.g., air, from the room and force it, via the fan, into manifold 20.

Alternatively, gas source 30 could comprise a compressed source of air, or may merely represent a connection to a external gas source of any type. If such a source of gas is pressurized, there will, of course, be no need to provide a fan as a part of gas source 30.

Figure 1:
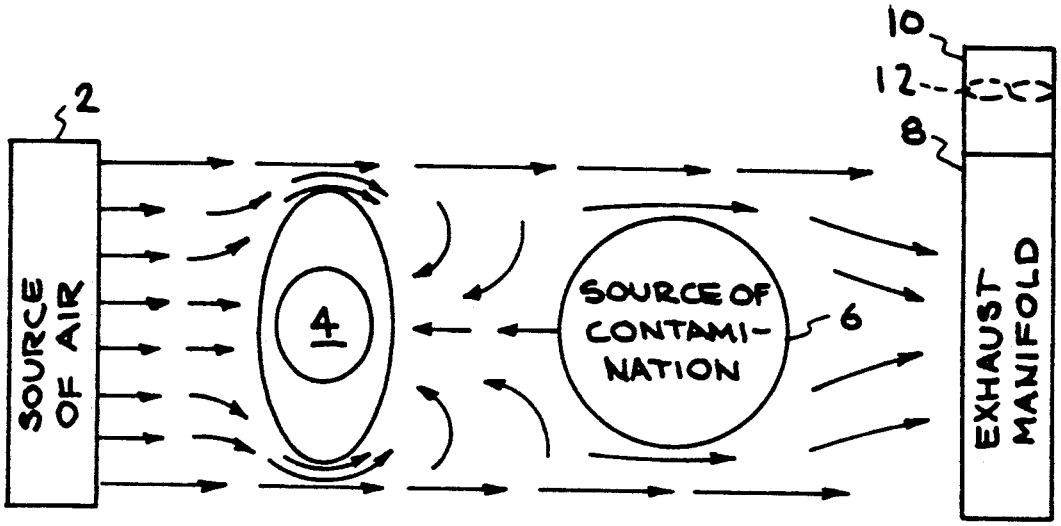
FIG. 1 (PRIOR ART)
FIG. 1 is a top view showing the conventional (prior art) flow of air horizontally around a person toward a source of contaminants and illustrating the generation of horizontal eddy currents back toward the person.
Figure 2:
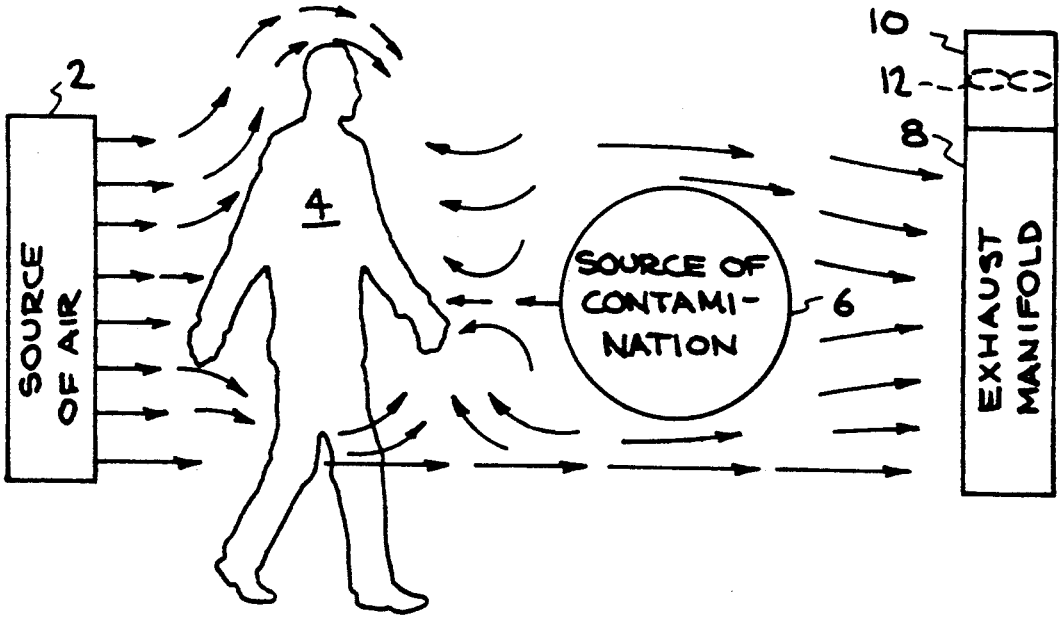
FIG. 2 (PRIOR ART)
FIG. 2 is a side view showing the conventional (prior art) flow of air vertically around a person toward a source of contaminants and illustrating the generation of vertical eddy currents back toward the person.

It will be readily appreciated that the effect of the gas flow through openings 22 in vest or manifold 20 away from the wearer 4 and toward the contaminants 6 is to eliminate the formation of the previously illustrated eddy currents in front of the wearer and to, in effect, make wearer 4 transparent with respect to the gas flow. In other words, when comparing, for example, the prior art gas flow shown in the top view of FIG. 1 with the gas flow illustrated in the top view of FIG. 4, the gas flow in front of the person flowing toward the contaminants is the same as if the person was not there, or transparent to a gas flow from a source behind the wearer.

Figure 6:
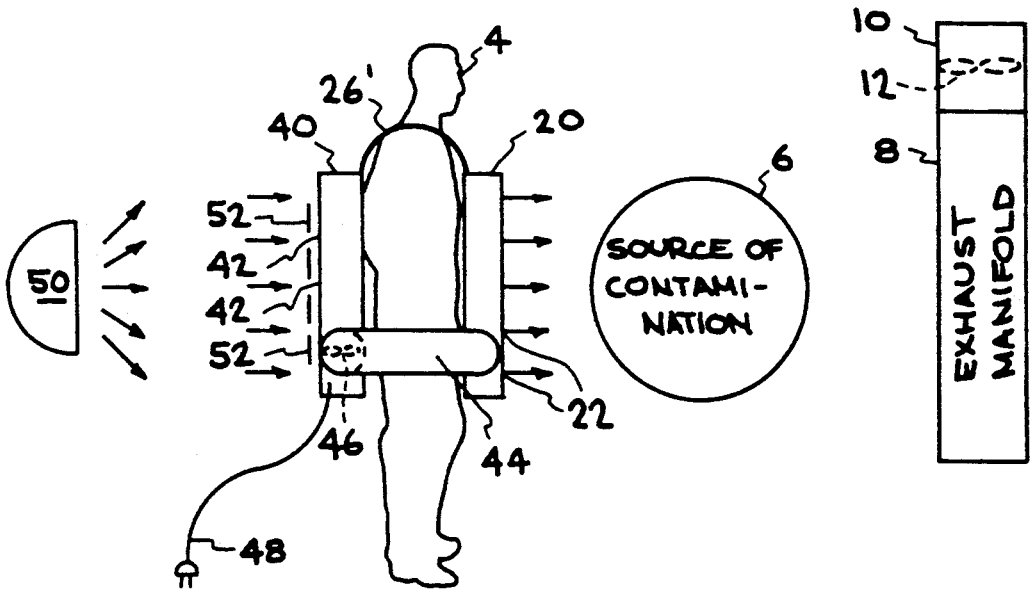
FIG. 6 is a side view of another embodiment of the invention wherein the source of the gas flow from the apparatus located in front of the person is an apparatus behind the person.

While the embodiment of FIGS. 3–5 indicate that the gas flowing out of openings 22 in gas manifold or vest 20 comes from an external gas source 30 connected to vest 20 via tube 24, the gas source may be either semi-self contained or completely self-contained as shown in FIG. 6.

In this embodiment, a second manifold 40 is shown strapped to the back of person 4 via straps 26'. Second manifold 40 is provided with gas intake openings 42 which permits gas flowing behind person 4 to be taken up by intake manifold 40 and then pumped into manifold 20 via a conduit 44 which interconnects manifolds 20 and 40.

Intake manifold is further provided with a fan 46 which draws gas (in this instance, for example, air) into manifold 40 and then transports it to outlet manifold 20 via conduit 44. For semi self-contained use, fan 46 may be powered electrically via an electric cord and plug 48 which will permit limited independent or self-contained movement by wearer 4 within the constraints of electric cord 48.

Alternatively, the embodiment shown in FIG. 6 may be completely self-contained by the provision of photovoltaic cells 52 connected to electric fan 46 to power it. As shown in FIG. 6, an external light source 50 of sufficient intensity may be provided to supplement the ambient light, if necessary, to provide sufficient illumination of photovoltaic cells 52 to generate the necessary level of electric power to energize fan 46.

In the latter instance, it will be recognized that the apparatus on the wearer will be completely self-contained, i.e., the wearer will not be constrained by any external gas conduits or electric cords to limit the extent of movement.

It should be further noted that the apparatus of the invention could be modified further to provide gas flow toward a source of contaminants through a helmet worn by the operator, either in place of, or as a supplement to the gas vest of the invention.

Figure 8:
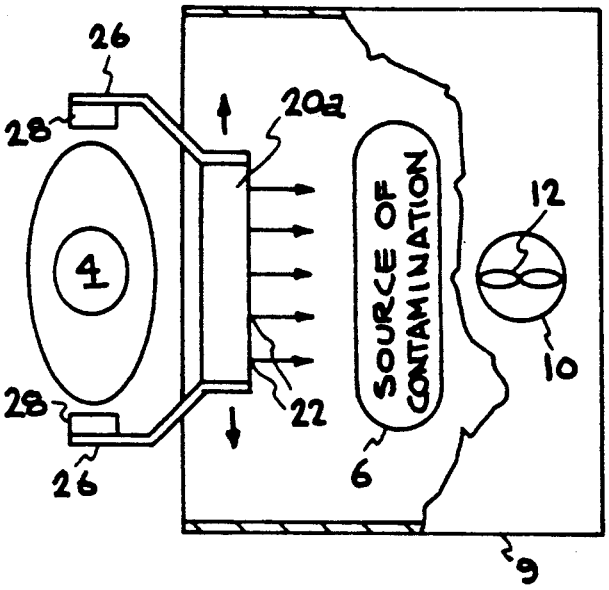
FIG. 8 is a top view of the embodiment of FIG. 7 showing sensing means which permit horizontal movement of the air flow apparatus based on horizontal movement of the person.
Figure 7:
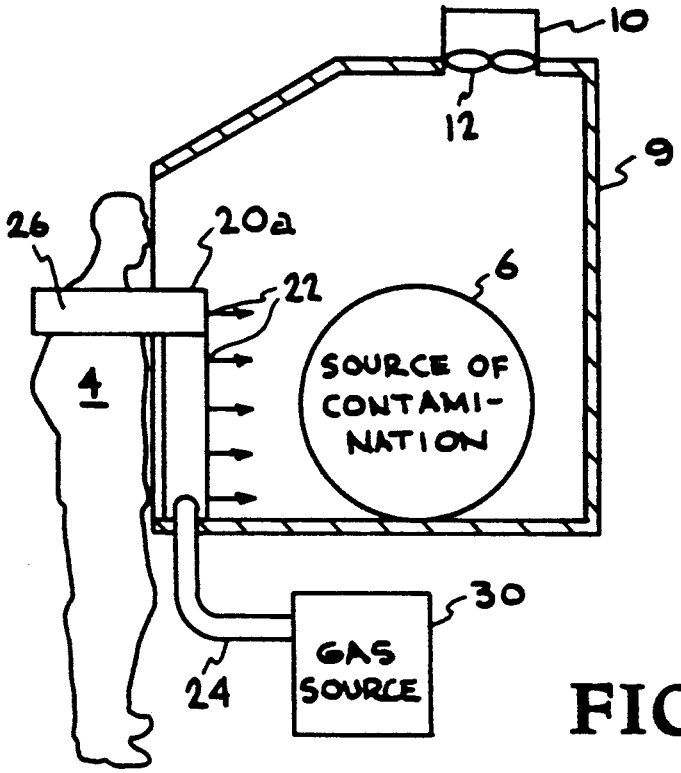
FIG. 7 is a side view of yet another embodiment of the invention wherein air flow apparatus in front of the person is attached to a portion of the exhaust hood.

Referring now to FIGS. 7 and 8, yet another embodiment is illustrated wherein the apparatus of the invention is shown slidably mounted to the front of an exhaust hood 9 in a manner which permits person 4 to stand in front of exhaust hood 9 with gas manifold 20*a* interposed between person 4 and the contaminant source 6. In this embodiment, as in the embodiment of FIGS. 3–5, manifold 20a may be supplied with gas from gas source 30 through flexible tube 24.

While this embodiment permits the user to enjoy the benefits of the invention without having to carry the gas manifold apparatus strapped to one's person, movement of the person is also afforded, as shown in FIG. 8, by the provision of side arms 26 having sensors 28 attached thereto which sense sideways movement of the user and cause manifold 20a to move horizontally with the user via energizing of a servo motor (not shown) which powers horizontal movement of manifold 20a. Alternatively, arms 26 may be used to provide non-motorized horizontal movement of manifold 20a by simply being engaged by the user, i.e., pushed sideways by the user to cause manifold 20a to roll sideways with the user.

Figure 9:
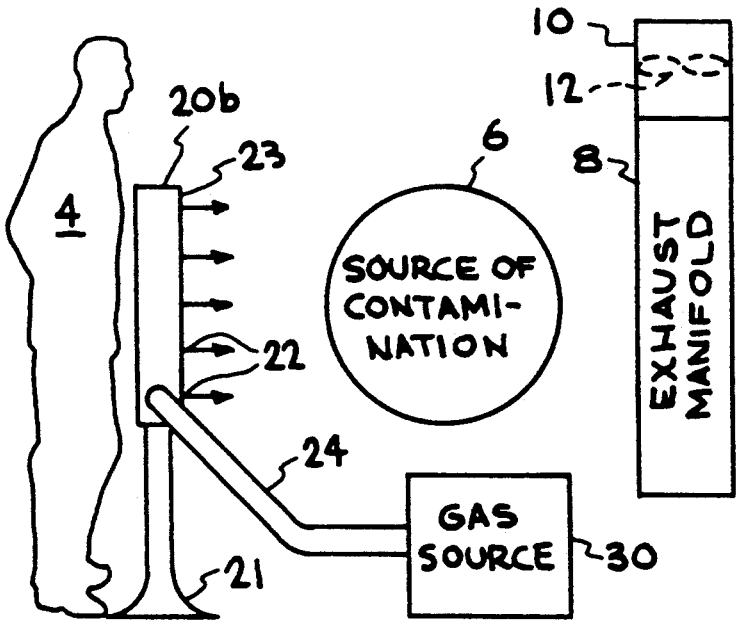
FIG. 9 is a vertical side view showing yet another embodiment of the invention wherein the air flow apparatus is mounted on a fixed pedestal behind which the person stands.

FIG. 9 shows yet another embodiment wherein manifold 2b is mounted on a pedestal 21 behind which the user stands. Pedestal 21 could be either a fixed or mobile pedestal, e.g., be on wheels. The user, in any case, would stand directly behind manifold 20b so that the gas flow coming out of openings 22 on the front face 23 and flowing toward contaminants 6 would protect person 4 from eddy currents forming in front of the user which would draw the contaminants back into the user's breathing zone.

To further illustrate the effectiveness of the apparatus of the invention, a full size standing mannequin was positioned in the face plane of a full size walk-in industrial exhaust hood. The hood had face dimensions of about 7 feet high and 6 feet wide, and a depth, in the direction of air flow, of about 6 feet. Downstream of the filter bank, which had an area of about 6 feet by 5 feet, was a low-pressure manifold connected to a variable speed fan which exhausted the air to the outside.

$SF_6$ tracer gas was released at a rate of 80 cc/minute at a point 40.75 inches above the floor (which equaled the height of the mannequin's elbow off the floor) and about 7 inches in front of the mannequin's stomach.

The mannequin was partly covered with electrical surface heaters to simulate a thermal plume similar to that from the body heat of a worker. An air vest was strapped to the front of the mannequin consisting of a 4 inch deep box having a 12 inch by 12 inch face having a square pattern of 64 13/64 inch diameter holes in the face through which air was expelled toward the $SF_6$ tracer gas.

Air samples for measuring tracer gas concentrations were collected at the nose and mouth of the mannequin; at 4.75 inches and 10 inches from the mannequin's mouth; 12 inches behind the mannequin; 10 inches in front of the knees of the mannequin; at the top edge of the center of the hood face; and at the center of the exhaust duct, downstream of the exhaust fan.

Figure 11:
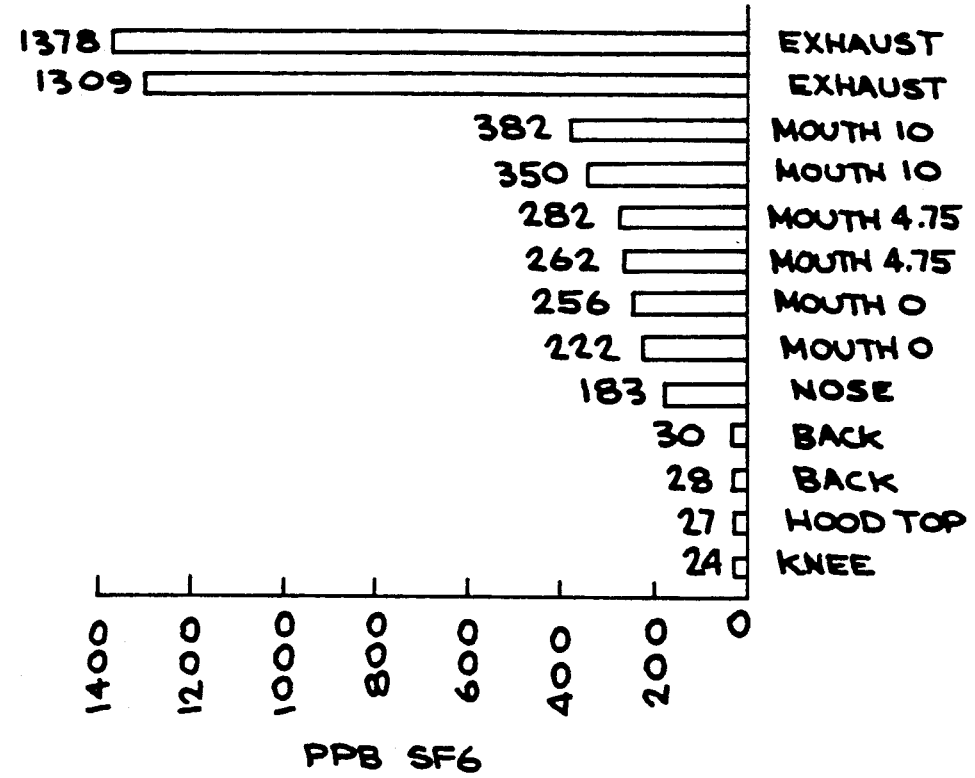
FIGS. 10–12 are graphs showing, respectively, the performance of the apparatus of the invention at various air flows when a hood face velocity of 56 fpm is utilized.
Figure 12:
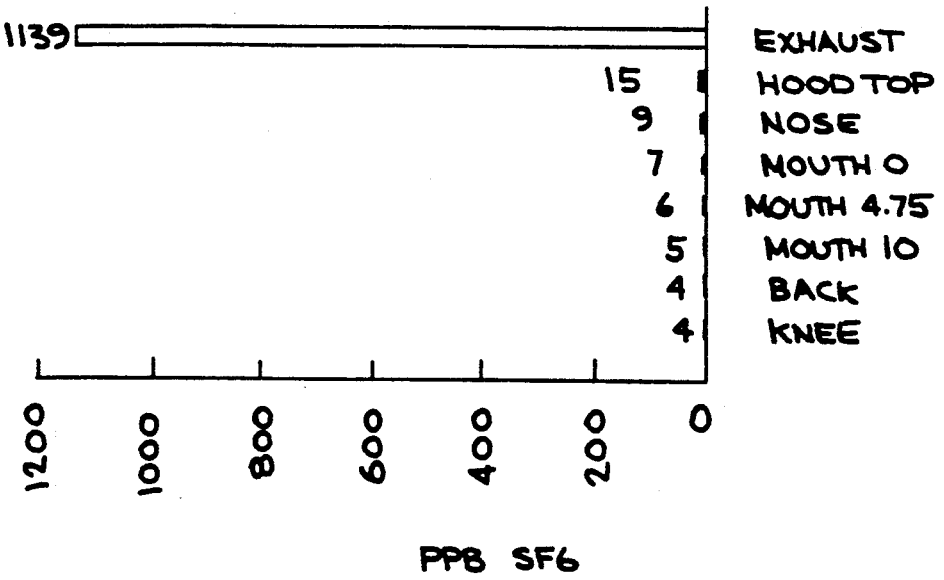

A first set of experiments was carried out with a hood face velocity of about 56 feet per minute (fpm) and air flows through the air vest respectively of 0, 4.2, and 40 cubic feet per minute (cfm). The results are respectively depicted in the graphs of FIGS. 10–12. The multiple readings shown correspond to two different readings taken from the same location, each averaged over different 15 minute intervals, and thus should be averaged together.

Figure 10:
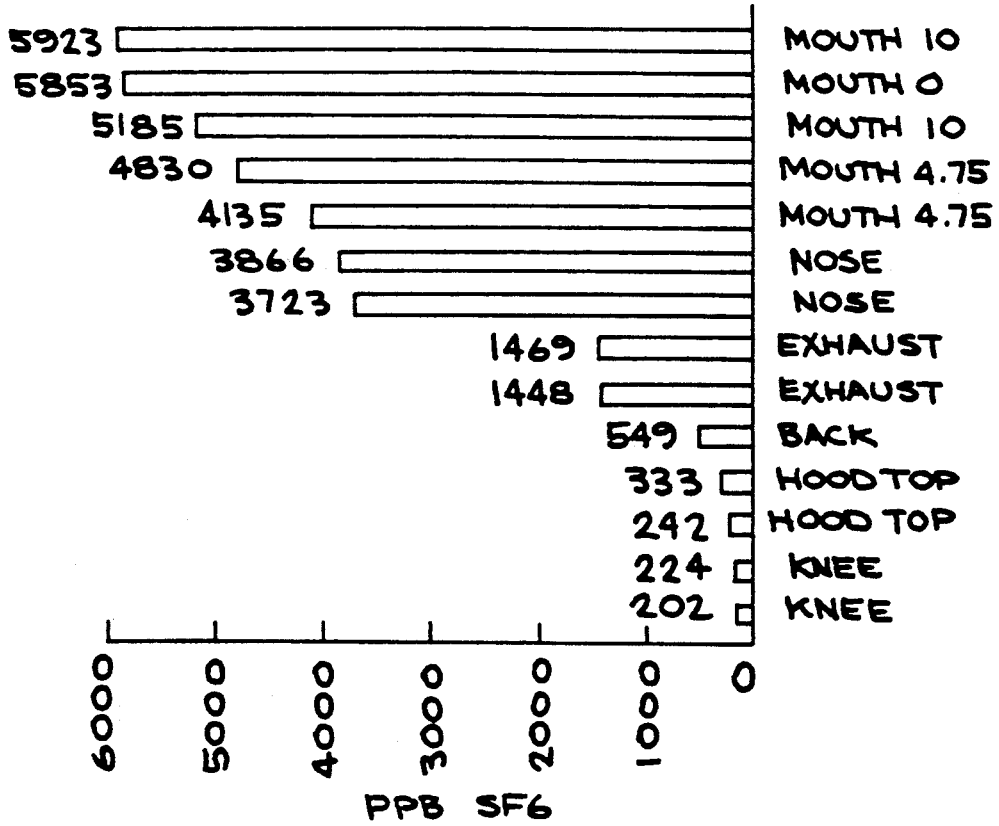

It will be seen that without the use of the apparatus of the invention, the contamination concentration adjacent the breathing zone, as shown in the graph of FIG. 10, is actually higher than the contaminant concentration in the exhaust leaving the hood.

Once an air flow of only 4.2 cfm is commenced through the air vest of the invention (FIG. 11), the amount of $SF_6$ tracer gas concentration adjacent the nose and mouth of the mannequin drastically drops. At an air flow of 40 cfm through the air vest of the invention (FIG. 12), almost all of the $SF_6$ tracer gas is detected in the exhaust with hardly any tracer gas detected adjacent the mannequin, including the breathing zone. For example, in FIG. 10, the contamination concentration adjacent the nose, without the use of Applicant's invention, was measured as 3723 ppb and 3866 ppb or an average of 3794 ppb. Compare this to the contaminant concentration adjacent the nose of 183 ppb in FIG. 11 (a reduction of almost 21 times), and only 9 ppb in FIG. 12 (a reduction of about 421 times).

Figure 13:
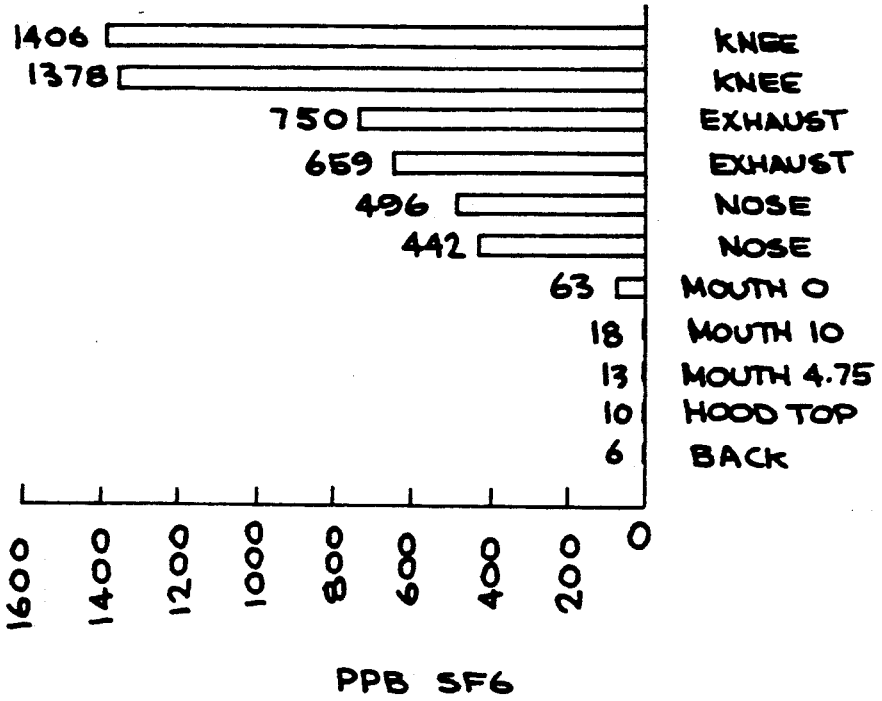
FIGS. 13–15 are graphs showing, respectively, the performance of the apparatus of the invention at various air flows when a hood face velocity of 118 fpm is utilized.
Figure 15:
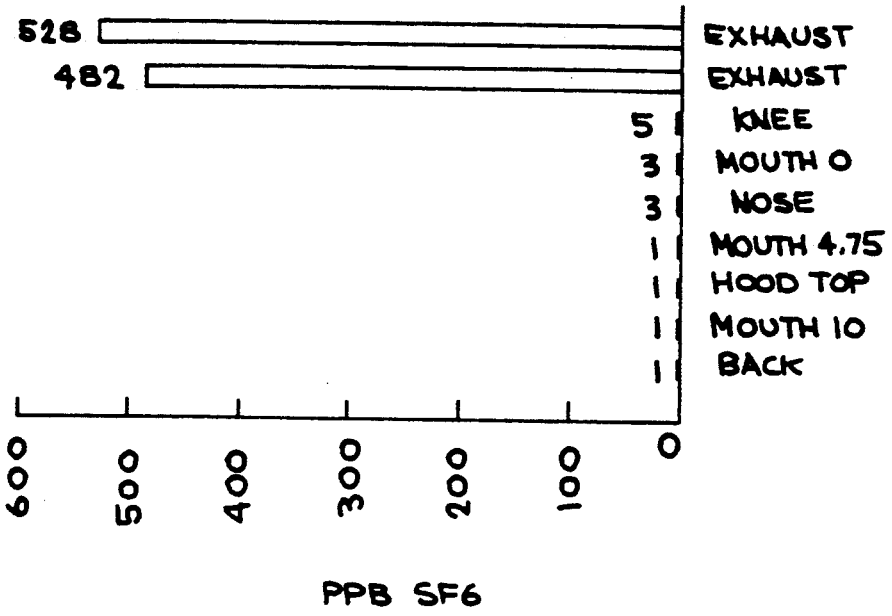
Figure 14:
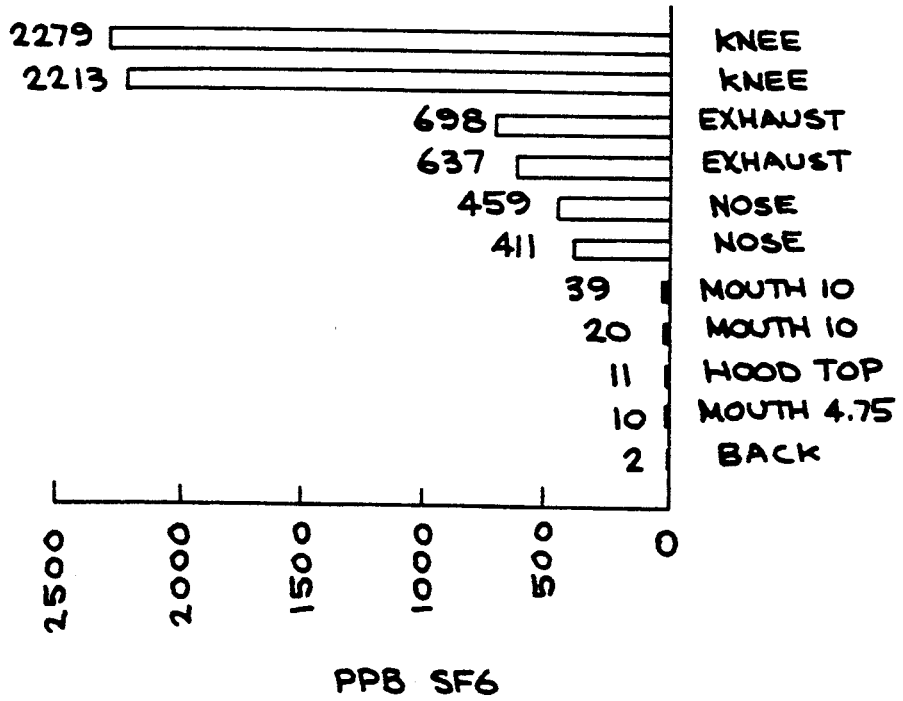

A second set of experiments were then carried out while providing a higher hood face velocity of 118 fpm, and using the same three air flow volumes through the air vest. The results are respectively depicted in the graphs of FIGS. 13–15. In this instance, the overall concentration of the $SF_6$ tracer gas, in the breathing zone of the mannequin, is lower than at the lower hood velocity, even without the use of the air vest (FIG. 13), due to the dilution of the eddy currents by the higher hood face velocity, as previously discussed. The concentration of $SF_6$ adjacent the nose is, however, lowered even when only an air vest air flow of 4.2 cfm is applied, as shown in FIG. 14, while FIG. 15 shows that even at such a high hood face velocity, there is still a marked reduction of the $SF_6$ tracer gas concentration adjacent the nose, for example, from an average of about 469 ppb in FIG. 13 down to 3 ppb in FIG. 15 (a reduction of about 156 times when an air flow of 40 cfm is flowed through the air vest of the invention.

Thus, the apparatus of the invention provides apparatus which will inhibit the flow of contaminants within an exhaust enclosure toward an individual located adjacent an opening into the exhaust enclosure. The apparatus of the invention provides a gas flow toward a source of contaminants from a position in front of an individual to urge said contaminants away from the individual toward an exhaust gas exit port.

Having thus described the invention what is claimed is:

1. Apparatus for inhibiting the formation of eddy currents in front of an individual, which eddy currents are capable of causing a substantially horizontal flow towards said individual from a source of contaminants interposed between said individual and an exhaust manifold comprising:

(a) a vest capable of being worn by said individual located adjacent an opening into said exhaust manifold, said vest having a gas porous portion thereof facing said source of contaminants;

(b) means for supplying air to said vest; and (c) fan means attached to said vest for forcing said air through said gas porous portion of said vest towards said source of contaminants so that the substantially horizontal flow component of said eddy currents is inhibited.

2. The apparatus of claim 1 which further includes air intake means also capable of being worn by said individual coupled to said vest and located behind said individual.

* * * * *